US006903291B2

(12) United States Patent
Oster

(10) Patent No.: US 6,903,291 B2
(45) Date of Patent: Jun. 7, 2005

(54) MULTI-WAY ELECTRIC SWITCH HAVING OPERATOR CONTROL SUPPORTED BY TWO ORTHOGONAL PARALLEL LINKAGES COUPLED VIA INTERMEDIATE PART

(75) Inventor: Christoph Oster, Lüdenscheid (DE)

(73) Assignee: Leopold Kostal GmbH & Co. KG, Ludenscheid (DE)

( * ) Notice: Subject to any disclaimer, the term of this patent is extended or adjusted under 35 U.S.C. 154(b) by 0 days.

(21) Appl. No.: 10/952,042

(22) Filed: Sep. 28, 2004

(65) Prior Publication Data

US 2005/0056530 A1 Mar. 17, 2005

Related U.S. Application Data

(63) Continuation of application No. PCT/EP03/04394, filed on Apr. 28, 2003.

(30) Foreign Application Priority Data

Apr. 30, 2002 (DE) ..... 102 19 477

(51) Int. Cl.[7] ..... H01H 25/00
(52) U.S. Cl. ..... 200/337; 200/336
(58) Field of Search ..... 200/1 R, 17 R, 200/18, 564, 329, 336, 337

(56) References Cited

U.S. PATENT DOCUMENTS 5,223,822 A * 6/1993 Stommes et al. ..... 137/551
6,605,786 B2 * 8/2003 Juret et al. ..... 200/4
6,797,907 B1 * 9/2004 Meagher et al. ..... 200/564
6,849,818 B2 * 2/2005 Koide et al. ..... 200/564

FOREIGN PATENT DOCUMENTS

| | | |
|---|---|---|
| DE | 44 10 201 A | 9/1995 |
| DE | 196 36 183 A | 3/1998 |
| DE | 198 58 118 C | 6/2000 |

* cited by examiner

*Primary Examiner*—Elvin G. Enad
*Assistant Examiner*—Lisa Klaus
(74) *Attorney, Agent, or Firm*—Brooks Kushman P.C.

(57) ABSTRACT

A multi-way electric switch includes an articulated suspension having parallel first and second linkages for movably mounting an operator control. Each linkage has a pair of rockers which are articulately coupled at first ends to an intermediate part such that the linkages are orthogonally to one another. The rockers of the first linkage are stationarily coupled at second opposite ends which are free with respect to the articulated coupling between the first linkage and the intermediate part. The rockers of the second linkage support the operator control at second opposite ends which are free with respect to the articulated coupling between the second linkage and the intermediate part. The articulated coupling between the rockers of the first linkage and the intermediate part lies in a first axis plane, and the articulated coupling between the rockers of the second linkage and the intermediate part lies in a second different axis plane.

20 Claims, 3 Drawing Sheets

MULTI-WAY ELECTRIC SWITCH HAVING OPERATOR CONTROL SUPPORTED BY TWO ORTHOGONAL PARALLEL LINKAGES COUPLED VIA INTERMEDIATE PART

CROSS-REFERENCE TO RELATED APPLICATIONS

This is a continuation of International Application PCT/EP03/04394, published in German, with an international filing date of Apr. 28, 2003, which is hereby incorporated by reference, and which claims priority to DE 102 19 477.7 filed Apr. 30, 2002.

BACKGROUND OF THE INVENTION

1. Field of the Invention

The present invention generally relates to a multi-way electric switch having an operator control that is movably mounted by an articulated suspension. The articulated suspension includes two four-jointed link elements arranged at right angles to one another. An intermediate part connects the two link elements. One link element is coupled in a stationary manner with its two joints that are free with respect to the intermediate part. The other link element supports the operator control or a holder for the operator control with its two joints that are free with respect to the intermediate part.

2. Background Art

Multi-way electric switches include an operator control that is mounted so that it can move in several directions on a surface. Such switches are often used as data entry devices in order to input data into a data processing device. The operator control can be used to navigate a menu making it possible to go to different menu items depending on the direction of motion of the operator control. Such switches are also used as joysticks. A part such as a switch lever is kinematically coupled to the motion of the operator control. The switch lever closes a switching contact in predetermined switch positions in order to execute the action assigned to this position of the operator control which might depend on the currently selected menu.

DE 196 36 183 C2 discloses a four-way rocker actuated switch having an operator control. An articulated suspension mounts the operator control such that it can move through an articulated suspension about two perpendicular axes. The suspension includes two four-jointed link elements that are spatially arranged on top of one another. The first and second link elements each include respective first and second pairs of rockers. The first pair of rockers are coupled to a stationary carrier and whose free ends are articulately coupled on an intermediate part. Thus, the elements involved in the structure of the first link element are the stationary carrier, the first pair of rockers, and the intermediate part. The articulated coupling between the first pair of rockers and the intermediate part is done through joint axes that are arranged parallel to the stationary carrier. The second link element uses the intermediate part as a base. The second pair of rockers support a holder for the operator control and whose free ends are articulately coupled on the intermediate part through joint axes.

The first link element allows the intermediate part to move back and forth in a first direction of motion. The perpendicular arrangement of the second link element to the first link element and its support on the intermediate part allows the operator control to move in a direction perpendicular to the direction of motion of the intermediate part when the second link element is exclusively operated. Simultaneous operation of the two link elements makes it possible to move the operator control through the operator control holder in almost any way that is desired within a switching field.

The switch described in DE 196 36 183 C2 is intended to make the operator control move on a curved surface so that when a user operates the operator control, the user gets the impression of making a swiveling motion. For this reason, the distance of the joint axes to the base of the two link elements—the coupling to the stationary carrier or to the intermediate part—is greater or smaller, depending on the desired form of the swiveling motion, than the distance of the joint axes to the articulated connection of the rockers with the respective other element—the intermediate part or the operator control holder. However, DE 196 36 183 C2 does not disclose how an operator control is suspended in order to give the user the impression that the operator control is moving on a plane.

Although the switch described in DE 196 36 183 C2 does allow articulated suspension of the operator control so that it can be moved in any way desired within a field of operation, the described switch requires a relatively considerable mounting depth. It should be taken into consideration that the length of the rockers coupled to the stationary carrier and to the operator control holder defines the amount of motion that is possible and thus the size of the operating field. This has the consequence that when designing a switch whose operator control is intended to cover a certain amount of motion, it is necessary to use correspondingly long rockers. However, the mounting space in numerous applications is not deep enough to realize such a switch.

SUMMARY OF THE INVENTION

Therefore, starting from the discussed background art, the present invention is based on further developing a multi-way electric switch in such a way that the mounting depth that is required is reduced without penalties on the mobility of the operator control.

The present invention solves this objective by providing a multi-way electric switch having an operator control which is supported by an articulated suspension. The articulated suspension includes a pair of parallel (i.e., first and second) four-jointed linkages arranged orthogonally to one another. The first and second linkages each include a pair of rockers, and are articulately coupled at one side to an intermediate part. That is, first ends (i.e., first joints) of the rockers of the first and second linkages are articulately coupled to the intermediate part. The first linkage is fixed (i.e., stationarily coupled) at its opposite side. That is, the second opposite ends (i.e., the second opposite joints) of the rockers of the first linkage are fixed. The second linkage supports the operator control or a holder for the operator control at its opposite side. That is, the second opposite ends (i.e., the second opposite joints) of the rockers of the second linkage support the operator control or the holder. The linkage axes planes in which the first and second linkages are articulately coupled to the intermediate part lie in different planes.

The distance between a base joint axis plane in which the two rockers of the first linkage are stationarily coupled and a joint axis plane in which the two rockers of the first linkage are articulately coupled to the intermediate part is equal to (or, alternatively, greater than) the distance between a base joint axis plane in which the two rockers of the second linkage are articularly coupled to the intermediate part and a joint axis plane in which the two rockers of the second linkage support an operator control or a holder for the operator control.

As such, the axes of the articulated connection between the rockers of the first linkage and the intermediate part is located in a first plane (i.e., an upper plane), and the axes of the articulated connection between the rockers of the second linkage and the intermediate part is located in a second different plane (i.e., a lower plane). Thus, the two linkages are nested in one another.

In DE 196 36 183 C2, the height of the structure is the sum of the heights of the two link elements. In accordance with the present invention, the height of the structure depends on the first linkage. As such, the structure height in accordance with the present invention is reduced as compared to the structure height in DE 196 36 183 C2. As the structure height in accordance with the present invention depends on the first linkage, it is possible to achieve a 50% reduction in the necessary mounting depth relative to the configuration disclosed in DE 196 36 183 C2.

For the case in which a movement of the operator control is provided without it making a swiveling motion with respect to its longitudinal axis, the elements involved in the structure of the first and second linkages are arranged in a type of parallelogram.

The reduction in mounting depth enables such a multi-way electric switch to be used as a rotating actuator in a motor vehicle. Such a rotating actuator has a rotating operator control which can rotate and also move in the plane defined by the suspension.

BRIEF DESCRIPTION OF THE DRAWINGS

The present invention is described below using a sample embodiment which refers to the attached figures. The figures are as follows.

DETAILED DESCRIPTION OF THE PREFERRED EMBODIMENT(S)

Figure 1:
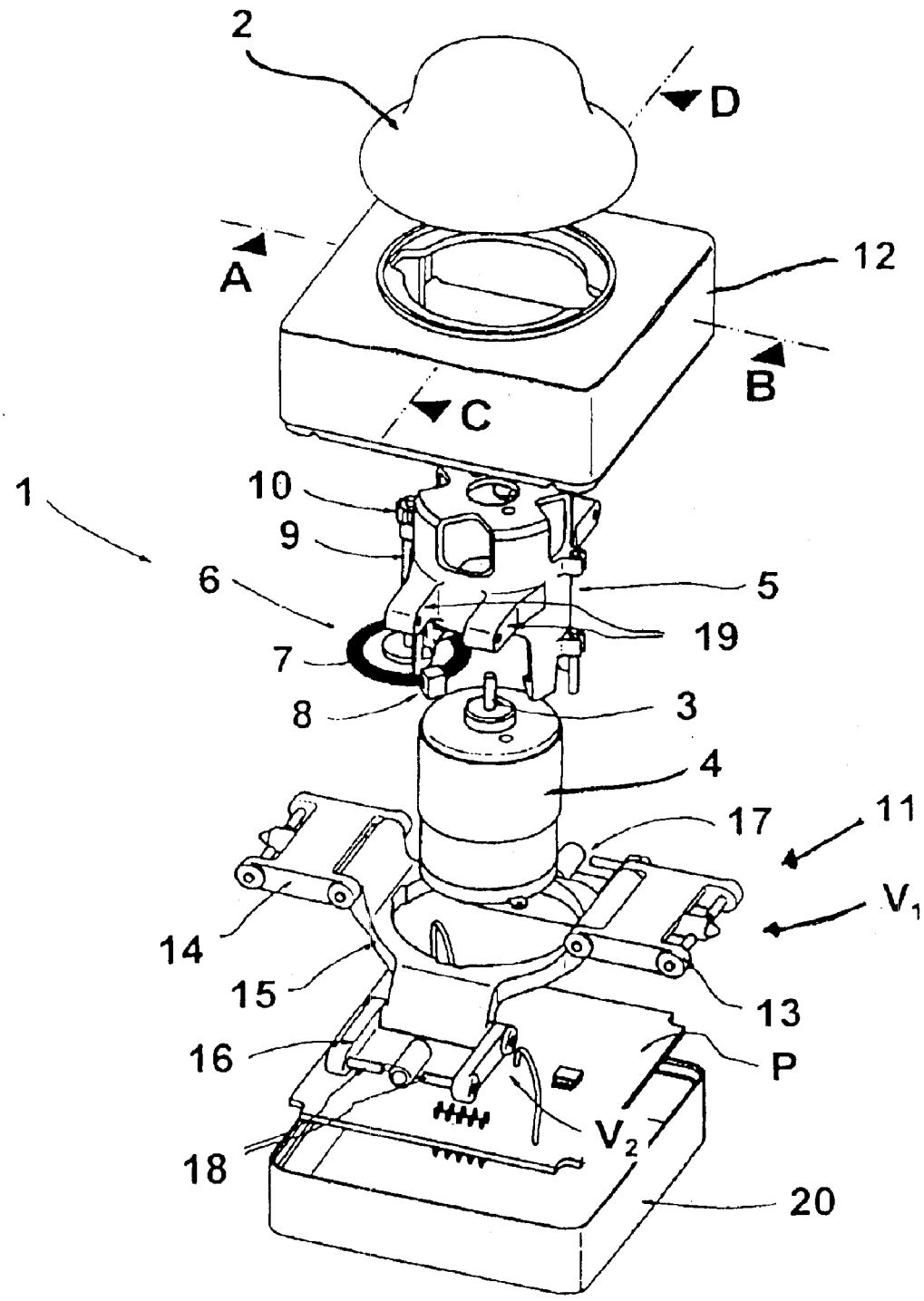
FIG. 1 illustrates an exploded view of a rotating actuator for manual data input in accordance with the present invention.

Referring now to the figures, a rotating actuator 1 in accordance with the present invention will now be described. Rotating actuator 1 generally serves as an operator control. To this end, rotating actuator 1 includes a handle 2 which is mounted to rotate on a drive shaft 3 of an electric motor 4. The connection between handle 2 and drive shaft 3 is torsionally rigid. Motor 4 provides tactile feedback when handle 2 is rotated. A cage 5 holds motor 4.

Cage 5 also supports a rotational motion detection device 6. Rotational motion detection device 6 includes an encoder disk 7 and a light barrier arrangement 8. Thus, rotational motion detection device 6 is optoelectronic. Encoder disk 7 is arranged in a torsionally rigid manner on a driven shaft 9 and acts as an angle sensor. A pinion gear 10 is also connected in a torsionally rigid manner with driven shaft 9. Pinion gear 10 serves as a driven gear and engages into internal teeth arranged on the inside of handle 2. Thus, rotational motion of handle 2 is transferred through pinion gear 10, which is engaged in the internal teeth, and driven shaft 9, to encoder disk 7. Light barrier arrangement 8 is held in a stationary manner on cage 5 so that it is opposite encoder disk 7. As such, cage 5 supports handle 2, motor 4, pinion gear 10, driven shaft 9, and rotational motion detection device 6.

Figure 3:
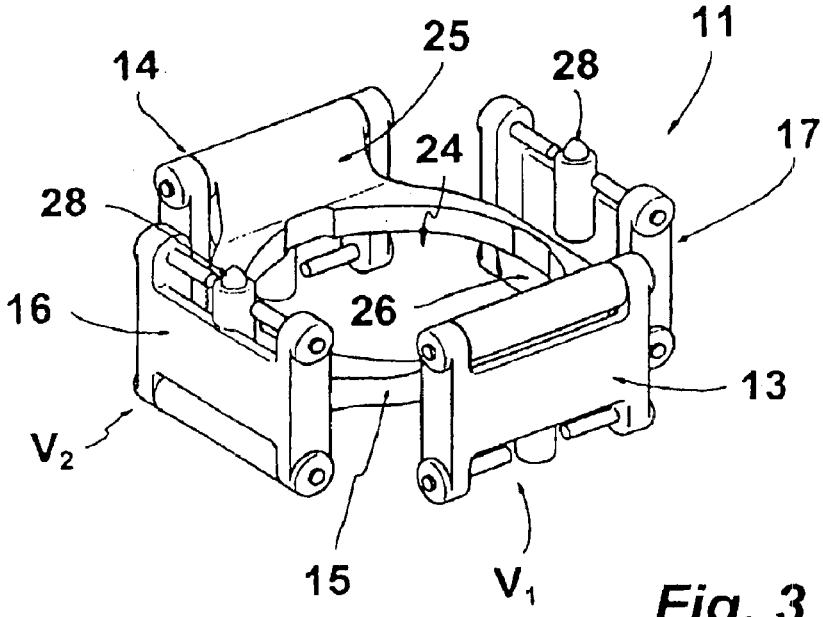
FIG. 3 illustrates a perspective view of the articulated suspension of the rotating actuator.

An articulated suspension 11 mounts cage 5 such that the cage is movable on a surface. Suspension 11 includes parallel first and second four-jointed linkages V1, V2. As shown in FIG. 3, suspension further 11 includes an intermediate part 15. First and second linkages V1, V2 are arranged orthogonally to one another (i.e. at about 90° given manufacturing tolerances) and are coupled together by intermediate part 15 in the assembled rotating actuator 1 as shown in FIG. 3. In general, first and second linkages V1, V2 are articulately coupled at one side to intermediate part 15 with the first linkage V1 being articulately coupled to the intermediate part in one (upper) plane and with the second linkage V2 being articulately coupled to the intermediate part in a different (lower) plane. As such, the linkage axes planes in which first and second linkages V1, V2 are articulately coupled to intermediate part 15 lie in different (upper and lower) planes.

First linkage V1 includes a first pair of rockers 13, 14. First ends (i.e., first joints) of rockers 13, 14 of first linkage V1 are articulately coupled to intermediate part 15. Second linkage V2 includes a second pair of rockers 16, 17. First ends (i.e., first joints) of rockers 16, 17 of second linkage V2 are articulately coupled to intermediate part 15. Rockers 16, 17 of second linkage V2 are articulately coupled to intermediate part 15 at right angles with respect to the articulate coupling between rockers 13, 14 of first linkage V1 and the intermediate part.

First linkage V1 is stationarily coupled (i.e., fixed) to the inside of an upper housing shell 12. That is, the second opposite ends (i.e., second opposite joints) of rockers 13, 14 of first linkage V1 which are free with respect to the articulated connection to intermediate part 15 are fixed to the inside of upper housing shell 12. Intermediate part 15 serves as a base for second linkage V2. Second linkage V2 supports cage 5 (i.e., supports an operator control or a holder for the operator control). That is, the second opposite ends (i.e., second opposite joints) of rockers 16, 17 of second linkage V2 which are free with respect to the articulated connection to intermediate part 15 support cage 5. The support provided to cage 5 by the second opposite ends of rockers 16, 17 of second linkage V2 may be done in an articulated manner. In order to support cage 5, floating axles 18 of rocker 16 engage into two extensions 19 of cage 5; and floating axles of rocker 17 engage into extensions of the cage in a corresponding manner.

A printed circuit board P is located beneath cage 5 and articulated suspension 11. Printed circuit board P is inserted into a lower housing shell 20 and has electrical/electronic components necessary to operate rotating actuator 1.

Figure 2:
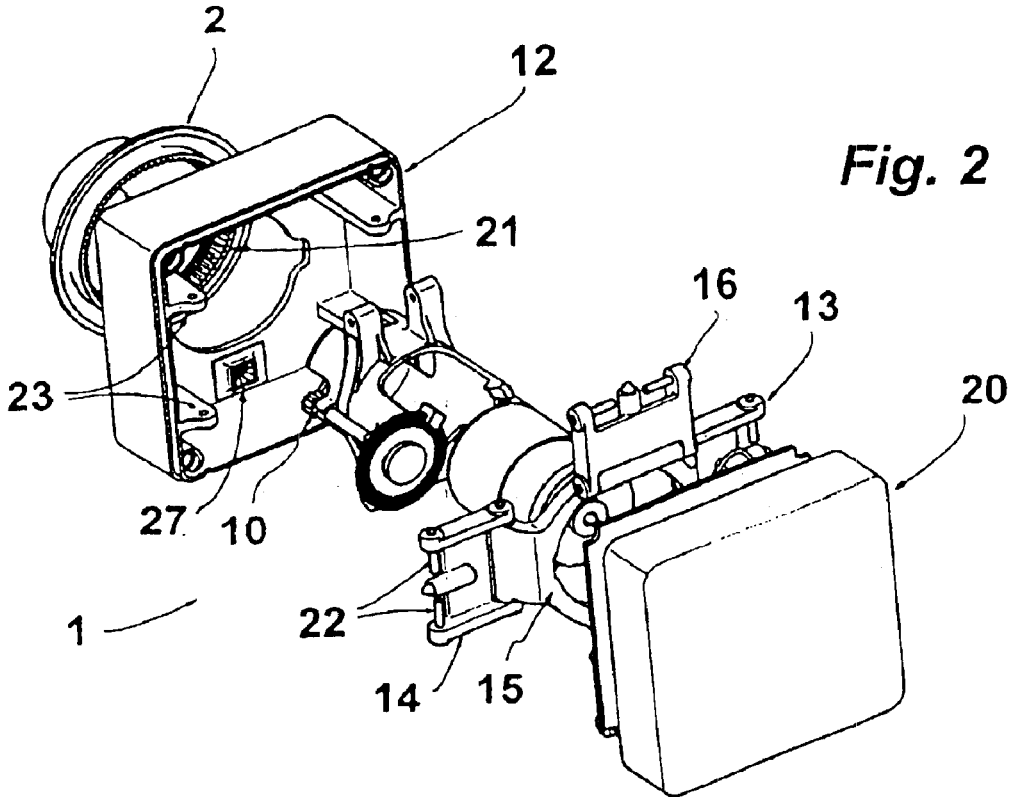
FIG. 2 illustrates an exploded view of the rotating actuator viewed from below with reference to FIG. 1.

The illustration in FIG. 2 shows, arranged on the inside of handle 2, the internal teeth 21 into which pinion gear 10 engages. Rocker 14 is mounted, with floating axles 22 in corresponding mounting extensions 23 on the inside of housing shell 12, to stationarily couple the second opposite end of rocker 14 to housing shell 12. The second opposite end of rocker 13 is stationarily coupled to housing shell 12 a corresponding manner.

Articulated suspension 11 is shown in FIG. 3 without its connection to housing shell 12 and cage 5. For clarity, it should be pointed out once again that the two rockers 13, 14 of first linkage V1 are coupled in a stationary manner to upper housing shell 12 with their second opposite ends which are free with respect to the articulated connection to intermediate part 15 shown in FIG. 3. By contrast, the two rockers 16, 17 of second linkage V2 support (articulately coupled) to cage 5 with their second opposite ends which are free with respect to the articulated connection to intermediate part 15 shown in FIG. 3.

Intermediate part 15 is ring-shaped so that cage 5 can engage into an inner opening 24 of the intermediate part. Intermediate part 15 a pair of joint extensions 25 projecting upward out of the plane shown and a pair of joint extensions 26 projecting downward out of the plane shown. Joint extensions 25 of intermediate part 15 are articulately connected to the first ends of rockers 13, 14 of first linkage V1 in an upper plane as shown in FIG. 3. Joint extensions 26 of intermediate part 15 are articulately connected to the first ends of rockers 16, 17 of second linkage V2 in a lower plane as shown in FIG. 3.

As such, the joint axes of rockers 13, 14 and 16, 17 are arranged in two planes. Lying in the upper plane are (a) the joint axes with which rockers 13, 14 of first linkage V1 are articulately coupled to intermediate part 15; and (b) the joint axes with which rockers 16, 17 of second linkage V2 support (i.e., articulated connected to) cage 5. Lying in the lower plane are (a) the joint axes with which rockers 13, 14 of first linkage V1 are stationarily coupled (i.e., fixed) to the inside of upper housing shell 12; and (b) the joint axes with which rockers 16, 17 of second linkage V2 are articulately coupled to intermediate part 16. The lower plane (i.e., the plane in which the joint axes with which first linkage V1 is stationarily coupled to upper housing shell 12) is designated as the base joint axis plane.

This nesting of first and second linkages V1, V2 provides an articulated suspension of cage 5 and its mobility within a field of movement, while keeping the height of the structure of articulated suspension 11 as small as possible. The height of articulated suspension 11 is the distance between (a) the point of the articulated coupling between the first ends of rockers 13, 14 of first linkage V1 and intermediate part 15 and (b) the point of the stationarily coupling between the second opposite ends of rockers 13, 14 of first linkage V1 and upper housing shell 12. As such, in this embodiment, the height of articulated suspension 11 is the distance between the upper joint axis plane and the lower (base) joint axis plane.

Articulated suspension 11 is designed in such a way that if cage 5 is moved within its field of movement, the orientation of its longitudinal axis does not change. To accomplish this, the distance of the joint axes to the base of the two linkages V1, V2—housing shell 12 or intermediate part 15, respectively—is exactly as large as the distance of the other joint axes, which have intermediate part 15 (for first linkage V1) and cage 5 (for second linkage V2) coupled to them. That is, the distance between a base joint axis plane in which rockers 13, 14 of first linkage V1 are stationarily coupled and a joint axis plane in which rockers 13, 14 of first linkage V1 are articulately coupled to intermediate part 15 is equal to the distance between a base joint axis plane in which rockers 16, 17 of second linkage V2 are articularly coupled to the intermediate part and a joint axis plane in which rockers 16, 17 of second linkage V2 support cage 5.

As such, the axis of the articulated connection between rockers 13, 14 of first linkage V1 is located in a first plane (i.e., an upper plane), and the axis of the articulated connection between rockers 16, 17 of second linkage V2 is located in a second different plane (i.e., a lower plane). Thus, the two linkages V1, V2 enclose parallelograms and are nested in one another such that movement of an element—intermediate part 15 or cage 5—opposite the base—housing shell 12 or intermediate part 15, respectively—always executes movements parallel to its base.

In the sample embodiment shown, the translational motion of rotating actuator 2 in its surface of movement is guided by two curved notches 27 (one such curved notch 27 is shown in FIG. 2). A catch bolt 28 engages into each of these curved notches 27. Catch bolts 28 are associated with rockers 16, 17 of second linkage V2.

Figure 4:
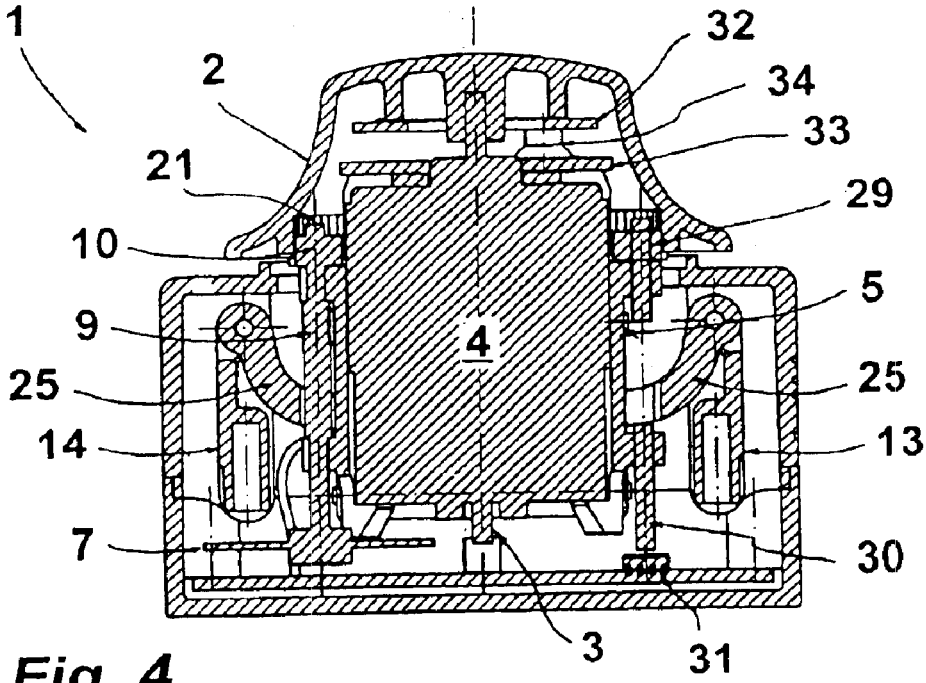
FIG. 4 illustrates a cross-sectional view of the rotating actuator in an assembly along the line A–B of FIG. 1.

The sectional illustration in FIG. 4 shows the engagement of the pinion gear 10 into the internal teeth 21 of handle 2. FIG. 4 also shows that cage 5 provides a damping element 29 that also engages into internal teeth 21 of handle 2. Damping element 29 dampens the rotating motion of handle 2. Cage 5 also supports a bar magnet 30 which serves as a locator for detecting the position of cage 5 within its field of movement. Bar magnet 30 interacts with a Hall sensor arrangement 31 which can detect the respective position of cage 5 in the possible positions that are specified by curved notches 27.

Figure 5:
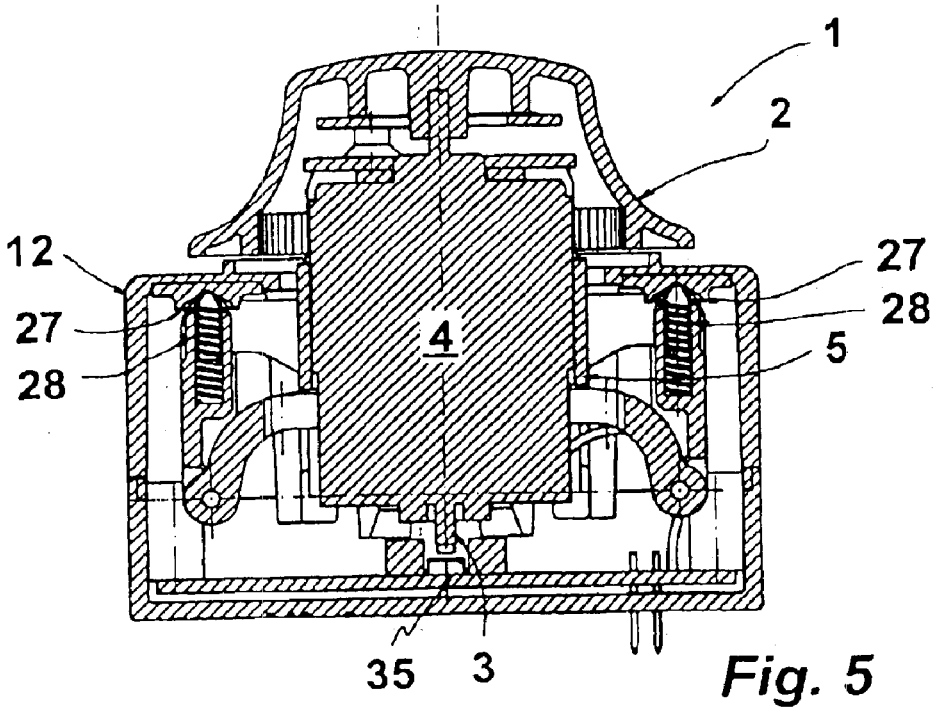
FIG. 5 illustrates a cross-sectional view of the rotating actuator in an assembly along the line C–D of FIG. 1.

On the inside, handle 2 is supported by a pressure flange 32 on an abutment plate 33 between which is an elastically deformable element 34. In the sample embodiment shown, element 34 is the switch thimble of a switch mat. Handle 2 can axially move against the material resilience of elastic element 34 so that this mobility of handle 2 makes it possible to select individual menu items when working with a menu. When handle 2 is axially moved the bottom section of drive shaft 3 of motor 4 correspondingly moves. This section interacts with a light barrier arrangement 35 arranged on printed circuit board P so that it is possible in this manner to detect whether handle 2 is in its normal position or in its axially pressed, and thus engaged position. Light barrier arrangement 35 is shown in the sectional illustration in FIG. 5. FIG. 5 also shows the engagement into curved notches 27, of the two catch bolts 28 which are held on the inside against housing shell 12.

The sample embodiment shown allows the rotating actuator to move without changing the orientation of its longitudinal axis. However, articulated suspension 11 can also be designed in such a way that the joint axes are spaced differently. For example, the spacing of the joint axes can be designed such that the distance between a base joint axis plane in which rockers 13, 14 of first linkage V1 are stationarily coupled and a joint axis plane in which rockers 13, 14 of first linkage V1 are articulately coupled to intermediate part 15 is greater than (instead of equal to) the distance between a base joint axis plane in which rockers 16, 17 of second linkage V2 are articularly coupled to intermediate part 16 and a joint axis plane in which rockers 16, 17 of second linkage V2 support cage 5. In this case, when rotating actuator 1 moves it changes the orientation of the longitudinal axis in order to achieve a rocker or tactile feedback similar to a joystick.

List of Reference Numbers

| | | | |
|---|---|---|---|
| 1 | Rotating actuator | 20 | Housing Shell |
| 2 | Handle | 21 | Internal Teeth |

-continued

| List of Reference Numbers | | | |
|---|---|---|---|
| 3 | Drive shaft | 22 | Floating Axle |
| 4 | Electric motor | 23 | Mounting Extension |
| 5 | Cage | 24 | Opening |
| 6 | Rotational motion detection device | 25 | Joint extension |
| 7 | Encoder disk | 26 | Joint extension |
| 8 | Light barrier arrangement | 27 | Curved notch |
| 9 | Driven shaft | 28 | Catch bolt |
| 10 | Pinion gear | 29 | Damping element |
| 11 | Suspension | 30 | Bar magnet |
| 12 | Housing shell | 31 | Hall sensor arrangement |
| 13 | Rocker | 32 | Pressure flange |
| 14 | Rocker | 33 | Abutment plate |
| 15 | Intermediate part | 34 | Elastic return element |
| 16 | Rocker | 35 | Light barrier arrangement |
| 17 | Rocker | P | Printed circuit board |
| 18 | Floating axle | V1 | First four-jointed linkage |
| 19 | Extension | V2 | Second four-jointed linkage |

While embodiments of the present invention have been illustrated and described, it is not intended that these embodiments illustrate and describe all possible forms of the present invention. Rather, the words used in the specification are words of description rather than limitation, and it is understood that various changes may be made without departing from the spirit and scope of the present invention.

What is claimed is:

1. A multi-way electric switch comprising:

an articulated suspension including first and second linkages for movably mounting an operator control, the first linkage having a first pair of rockers and the second linkage having a second pair of rockers;

an intermediate part, wherein the rockers of the first and second linkages are articulately coupled at first ends to the intermediate part such that the first and second linkages are arranged orthogonally to one another;

wherein the rockers of the first linkage are stationarily coupled at second opposite ends which are free with respect to the articulated coupling between the first linkage and the intermediate part;

wherein the rockers of the second linkage support the operator control or a holder for the operator control at second opposite ends which are free with respect to the articulated coupling between the second linkage and the intermediate part;

wherein the articulated coupling between the rockers of the first linkage and the intermediate part lies in a first axis plane, and the articulated coupling between the rockers of the second linkage and the intermediate part lies in a second different axis plane.

2. The switch of claim 1 wherein:

the first axis plane is an upper axis plane and the second axis plane is a lower axis plane.

3. The switch of claim 1 wherein:

the distance between a base joint axis plane in which the rockers of the first linkage are stationarily coupled and a joint axis plane in which the two rockers of the first linkage are articulately coupled to the intermediate part corresponds to the distance between a base joint axis plane in which the two rockers of the second linkage are articularly coupled to the intermediate part and a joint axis plane in which the two rockers of the second linkage support the operator control or the holder for the operator control.

4. The switch of claim 1 wherein:

the articulated coupling between the rockers of the first linkage and the intermediate part is located in an upper axis plane, and the articulated coupling between the rockers of the second linkage and the intermediate part is located in a lower axis plane such that the first and second linkages are nested in one another.

5. The switch of claim 1 wherein:

the articulated coupling between the rockers of the first linkage and the support provided by the rockers of the second linkage to the operator control or the holder for the operator control lie in the first axis plane.

6. The switch of claim 5 wherein:

the stationarily coupling of the rockers of the first linkage and the articulated coupling between the rockers of the second linkage and the intermediate part lie in the second axis plane.

7. The switch of claim 1 wherein:

the intermediate part has a first pair of extensions extending upward and a second pair of extensions extending downward, wherein the rockers of the first linkages are articulately coupled at the first ends to the first pair of extensions, respectively, and wherein rockers of the second linkages are articulately coupled at the first ends to the second pair of extensions, respectively.

8. The switch of claim 1 wherein:

the distance between (a) the first axis plane in which the rockers of the first linkage are articulately coupled to the intermediate part and (b) the second axis plane in which the rockers of the first linkage are stationarily coupled corresponds to the distance between (a) the first axis plane in which the rockers of the second linkage support the operator control or the holder for the operator control and (b) the second axis plane in which the rockers of the second linkage are articulately coupled to the intermediate part.

9. The switch of claim 1 wherein:

the distance between (a) a base joint axis plane in which the rockers of the first linkage are stationarily coupled and (b) a joint axis plane in which the two rockers of the first linkage are articulately coupled to the intermediate part is greater than the distance between (a) a base joint axis plane in which the two rockers of the second linkage are articularly coupled to the intermediate part and (b) a joint axis plane in which the two rockers of the second linkage support the operator control or the holder for the operator control.

10. The switch of claim 1 wherein:

the switch is a rotating actuator.

11. A multi-way electric switch comprising:

an articulated suspension including first and second linkages for movably mounting an operator control;

an intermediate part, wherein the first and second linkages are articulately coupled at first ends to the intermediate part such that the first and second linkages are arranged orthogonally to one another;

wherein the first linkage is stationarily coupled relative to the operator control at a second end opposite to the first end of the first linkage;

wherein the second linkage supports the operator control or a holder for the operator control at a second end which is opposite to the first end of the second linkage;

wherein the articulated coupling between the first end of the first linkage and the intermediate part lies in a first axis plane, and the articulated coupling between the first end of the second linkage and the intermediate part lies in a second different axis plane.

12. The switch of claim 11 wherein:

the first axis plane is an upper axis plane and the second axis plane is a lower axis plane.

13. The switch of claim 11 wherein:

the distance between a base joint axis plane in which the first linkage is stationarily coupled relative to the operator control and a joint axis plane in which the first linkage is articulately coupled to the intermediate part corresponds to the distance between a base joint axis plane in which the second linkage is articularly coupled to the intermediate part and a joint axis plane in which the second linkage supports the operator control or the holder for the operator control.

14. The switch of claim 11 wherein:

the articulated coupling between the first linkage and the intermediate part is located in an upper axis plane, and the articulated coupling between the second linkage and the intermediate part is located in a lower axis plane such that the first and second linkages are nested in one another.

15. The switch of claim 11 wherein:

the articulated coupling between the first linkage and the support provided by the second linkage to the operator control or the holder for the operator control lie in the first axis plane.

16. The switch of claim 15 wherein:

the stationarily coupling of the first linkage relative to the operator control and the articulated coupling between the second linkage and the intermediate part lie in the second axis plane.

17. The switch of claim 11 wherein:

the intermediate part has a first pair of extensions extending upward and a second pair of extensions extending downward, wherein the first linkages are articulately coupled at their first ends to the first pair of extensions, respectively, and wherein the second linkages are articulately coupled at their first ends to the second pair of extensions, respectively.

18. The switch of claim 11 wherein:

the distance between (a) the first axis plane in which the first linkage is articulately coupled to the intermediate part and (b) the second axis plane in which the first linkage is stationarily coupled relative to the operator control corresponds to the distance between (a) the first axis plane in which the second linkage supports the operator control or the holder for the operator control and (b) the second axis plane in which the second linkage is articulately coupled to the intermediate part.

19. The switch of claim 11 wherein:

the distance between (a) a base joint axis plane in which the first linkage is stationarily coupled relative to the operator control and (b) a joint axis plane in which the first linkage is articulately coupled to the intermediate part is greater than the distance between (a) a base joint axis plane in which the second linkage is articularly coupled to the intermediate part and (b) a joint axis plane in which the second linkage supports the operator control or the holder for the operator control.

20. The switch of claim 11 wherein:

the switch is a rotating actuator.

* * * * *